US007540950B2

(12) United States Patent
Riedl et al.

(10) Patent No.: US 7,540,950 B2
(45) Date of Patent: Jun. 2, 2009

(54) ELECTRICALLY CONDUCTIVE BODY INCLUDING AN ADHESION PROMOTER LAYER, AND PROCESS FOR DEPOSITING AN ADHESION PROMOTER LAYER

(75) Inventors: Edmund Riedl, Obertraubling-Gebelkofen (DE); Wolfgang Schober, Amberg (DE)

(73) Assignee: Infineon Technologies, AG, Neubiberg (DE)

( * ) Notice: Subject to any disclaimer, the term of this patent is extended or adjusted under 35 U.S.C. 154(b) by 512 days.

(21) Appl. No.: 11/321,451

(22) Filed: Dec. 30, 2005

(65) Prior Publication Data

US 2006/0154103 A1 Jul. 13, 2006

Related U.S. Application Data

(63) Continuation of application No. PCT/DE2004/001149, filed on Jun. 4, 2004.

(30) Foreign Application Priority Data

Jul. 3, 2003 (DE) ..... 103 30 192

(51) Int. Cl.

| | |
|---|---|
| ***C25D 3/22*** | (2006.01) |
| ***C25D 3/56*** | (2006.01) |
| ***C25D 7/12*** | (2006.01) |
| ***C23C 28/00*** | (2006.01) |
| ***C23C 20/02*** | (2006.01) |

(52) U.S. Cl. ..... 205/244; 205/157; 205/191; 205/192; 205/238; 205/305

(58) Field of Classification Search ..... 205/191, 205/192, 238, 244, 157, 305
See application file for complete search history.

(56) References Cited

U.S. PATENT DOCUMENTS

| | | | | |
|---|---|---|---|---|
| 3,672,996 | A * | 6/1972 | Louzos | 429/207 |
| 4,668,471 | A | 5/1987 | Futatsuka et al. | |
| 5,098,796 | A | 3/1992 | Lin et al. | |
| 5,183,552 | A | 2/1993 | Bressel et al. | |
| 5,209,987 | A | 5/1993 | Penneck et al. | |
| 5,343,073 | A | 8/1994 | Parthasarathi et al. | |
| 5,626,736 | A | 5/1997 | Florio et al. | |
| 5,693,209 | A | 12/1997 | Bressel et al. | |
| 5,830,975 | A | 11/1998 | Perrauld et al. | |
| 5,955,936 | A | 9/1999 | Shaw, Jr. et al. | |
| 6,169,246 | B1 | 1/2001 | Wu et al. | |
| 6,878,486 | B2 * | 4/2005 | Schubert et al. | 429/185 |
| 2003/0118861 | A1 | 6/2003 | Heimann et al. | |

FOREIGN PATENT DOCUMENTS

| | | |
|---|---|---|
| DE | 197 31 424 C1 | 8/1998 |
| RU | 2 070 947 C1 | 11/1991 |

* cited by examiner

*Primary Examiner*—Edna Wong
(74) *Attorney, Agent, or Firm*—Edell, Shapiro & Finnan, LLC

(57) ABSTRACT

An electrically conductive body, which in particular includes a metal and/or an alloy and/or a semiconductor, includes an adhesion promoter layer provided on at least one surface of the electrically conductive body. The adhesion promoter layer includes a metal, in particular zinc, and a porous, in particular platelike and/or needle-shaped and/or sponge-like, surface structure.

9 Claims, 1 Drawing Sheet

ELECTRICALLY CONDUCTIVE BODY INCLUDING AN ADHESION PROMOTER LAYER, AND PROCESS FOR DEPOSITING AN ADHESION PROMOTER LAYER

CROSS REFERENCE TO RELATED APPLICATIONS

This application is a continuation of PCT/DE2004/001149, filed on Jun. 4, 2004, and titled "Electrically Conducting Element Comprising an Adhesive Layer, and Method for Depositing an Adhesive Layer," which claims priority under 35 U.S.C. §119 to German Application No. DE 103 30 192.5, filed on Jul. 3, 2003, and titled "Electrically Conductive Body Having an Adhesive Layer, and Process for Depositing an Adhesion Promoter Layer," the entire contents of which are hereby incorporated by reference.

FIELD OF THE INVENTION

The invention relates to an electrically conductive body having an adhesion promoter layer, and to a process for depositing an adhesion promoter layer.

BACKGROUND

The adhesion of polymers to metal surfaces is often realized by chemical bonding between the functional groups of the polymer and the metal surface. In many cases, only inadequate adhesion forces result between the metal and the polymer. Adhesion promoters, which are supposed to improve the adhesion between the polymer and the metal, are often used between the two substances. This can give rise to the problem that the electrical properties of the surface of the metal which is often present as an electrical circuit are adversely affected by adhesion promoters of this type. Moreover, adhesion promoters of this type often cannot reach the edges of the metallic surface, or can do so only with difficulty, resulting in relatively weak adhesion forces between the two substances.

SUMMARY

It is an object of the invention to improve the adhesion of polymers to metallic surfaces, in particular to semiconductors.

Another object of the invention is to provide a process for depositing a layer with particularly good adhesion-promoting properties on metallic surfaces which is inexpensive and simple to carry out.

The aforesaid objects are achieved individually and/or in combination, and it is not intended that the present invention be construed as requiring two or more of the objects to be combined unless expressly required by the claims attached hereto.

In accordance with the present invention, an electrically conductive body includes an adhesion promotion layer on at least one of its surfaces. This adhesion promoter layer is characterized by its rough and porous condition or morphology. The porosities are in the range from 10-1000 nm. This condition may be characterized by crystalline structures and/or platelet and sponge structures. Furthermore, needle-shaped pillars may project randomly next to one another out of the layer. These needle-shaped structures and the platelets may be provided with sharp and precise edges. A highly magnified cross section through such platelets and needle-shaped structures of the adhesion promoter layer shows that they generally have triangular to hexagonal basic contours.

The adhesion promoter layer formed in this way comprises zinc. In particular, metals, alloys or semiconductor materials, in particular silicon (Si), germanium (Ge) or gallium arsenide (GaAs), are provided as substances for the electrically conductive body.

The above and still further objects, features and advantages of the present invention will become apparent upon consideration of the following detailed description of specific embodiments thereof, particularly when taken in conjunction with the accompanying drawings.

DETAILED DESCRIPTION

Figure 1:
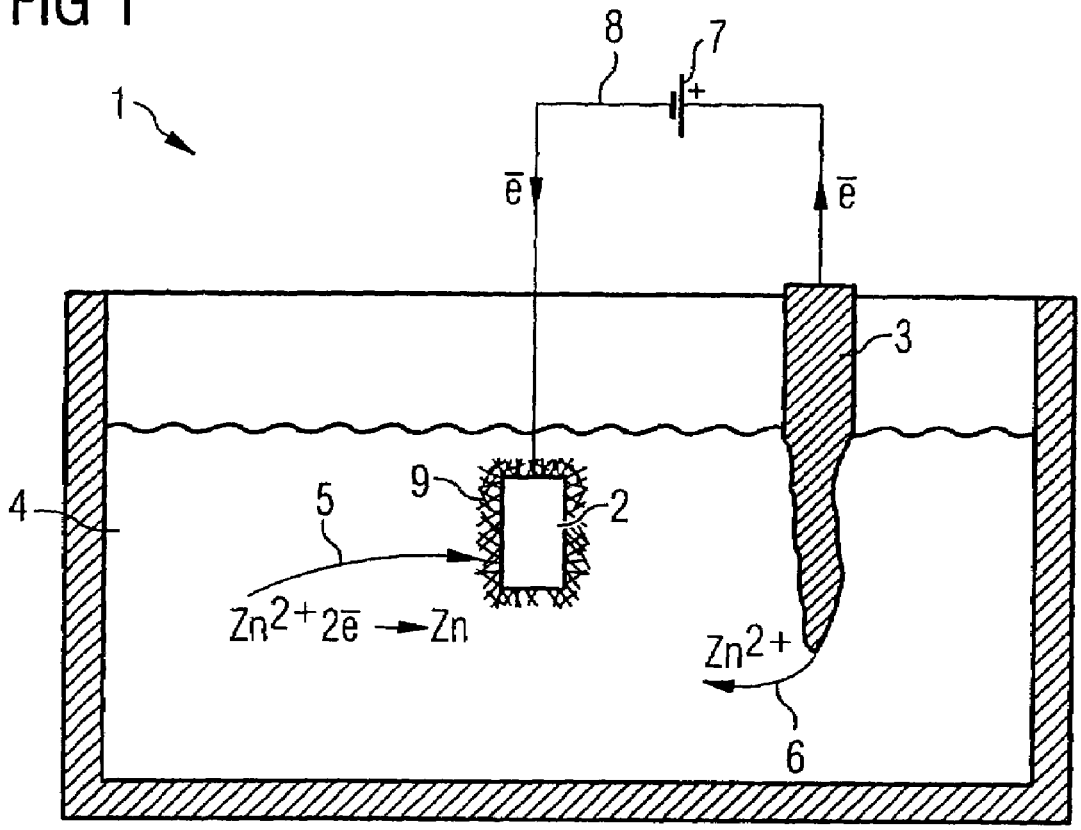
FIG. 1 depicts a side view in cross section of an electroplating bath.

An electrically conductive body is formed in accordance with the present invention including an adhesion promotion layer on at least one of its surfaces. This adhesion promoter layer is characterized by its rough and porous condition or morphology. The porosities are in the range from 10-1000 nm. This condition may be characterized by crystalline structures and/or platelet and sponge structures. Furthermore, needle-shaped pillars may project randomly next to one another out of the layer. These needle-shaped structures and the platelets may be provided with sharp and precise edges. A highly magnified cross section through such platelets and needle-shaped structures of the adhesion promoter layer shows that they generally have triangular to hexagonal basic contours. The adhesion promoter layer formed in this way comprises zinc. In particular, metals, alloys or semiconductor materials, in particular silicon (Si), germanium (Ge) or gallium arsenide (GaAs), are provided as substances for the electrically conductive body.

The porous and rough condition of the adhesion promoter layer brings about much stronger adhesion of the polymer to the electrically conductive body. The bonding forces produced are much stronger than with a homogeneous and smooth metal surface. The bonding forces between the functional groups of the polymer and the metal oxides are also markedly stronger than the bonding forces which can be achieved by mechanical interlocking formations which can be produced on a macro-scale by substrate design.

This is because the morphologies of the porous adhesion promoter layer according to the invention have a particularly large surface area compared to untreated, rolled or homogeneous surfaces. Consequently, the functional groups of the polymer have a very large surface available for bonding to the metal oxides of the adhesion promoter layer.

In accordance with another embodiment of the present invention, a plastic composite body is provided that comprises a polymer and the electrically conductive body described above, including its porous adhesion promoter layer.

At least one surface of the polymer is joined to at least one surface of the electrically conductive body by the porous adhesion promoter layer. The polymer can be applied to the electrically conductive body, for example, by injection-molding and other molding processes. Due to the rough and porous condition of the adhesion promoter layer, the polymer can be particularly reliably and tightly bonded to the adhesion promoter layer and therefore to the microchip. Thus, the polymer engages with the rough surface so as even to produce a positively locking connection.

A plastic composite body formed in this way, which may be designed for example as a microchip, is hardly susceptible at all to what is known as the popcorn effect. The popcorn effect is to be understood as meaning the phenomenon whereby a cladding or encapsulant jumps off a microchip as a result of the heating of water which is diffused into the interfacial layer between the polymer and the metallic surface. The popcorn effect is often boosted by the fact that, due to the different coefficients of thermal expansion, microcracks are often formed at the interfaces between the polymer encapsulation and the microchip in the event of thermal stresses, and it is easy for water to pass through these cracks to the interfaces. The adhesion promoter layer of the present invention does not produce any interfaces or free spaces and therefore also does not produce any micro-cracks between the polymer and the metallic surface of the microchip, into which water could otherwise penetrate.

In a further embodiment of the present invention, an electrolytic solution is provided for an electroplating bath. Electroplating baths are divided into alkaline baths and acidic baths; alkaline baths are particularly suitable for the deposition process according to the invention. The alkaline baths may be based on hydroxo or cyano complexes or diphosphates of the metals that are to be deposited. The electroplating bath according to the invention, in addition to an electrolytic solution, also comprises two electrodes and a current source.

The electrolytic solution according to the invention contains at least four main components, namely at least one base, at least one oxidizing agent, at least one silicate and at least one salt of the corresponding base or bases. This electrolytic solution can be used to deposit homogeneously distributed adhesion promoter layers on a very wide range of chip systems. The electrolytic solution according to the invention allows homogeneous coating of even complex geometries.

Bases are substances which in aqueous solution release $OH^-$ ions and function as proton acceptors. The base used on the electrolytic solution may be a potassium hydroxide solution (KOH) with a concentration of 1-500 mmol/l. The potassium hydroxide solution (KOH) dissociates into $OH^-$ ions, on the one hand, and $K^+$ ions, on the other hand, which then react with zinc ions to form salts.

Oxidizing agents are electron-receiving substances which are themselves reduced during redox reactions. A redox system, i.e. reduction and oxidation system, is an electron-accepting and electron-donating system. It forms the basis of any oxidation or reduction, since if electrons are withdrawn from one substance, they have to be supplied to another substance, and vice versa. Exemplary oxidizing agents used in the electrolytic solution of the invention include vanadates ($VO_4^{3-}$), molybdates ($MoO_4^{2-}$), permanganates ($MnO_4^-$) and tungstates ($WO_4^{2-}$).

One function of the oxidizing agent in the present invention is to accelerate the operation of depositing the adhesion promoter layer in such a manner that it is not a homogeneous layer that is deposited, but rather a porous and/or plateletlike and/or needle-shaped layer, in order to ensure improved adhesion of the polymer.

Silicates are compounds of silicic acid. In the present invention, the silicates used may be water glasses, which represent aqueous solutions of alkali metal silicates. Water glasses are clear viscous liquids with a density of 1.4-1.5 $g/cm^3$. The silicates are used to stabilize the electrolytic solution by preventing reverse reactions of the zinc ions to form zinc hydroxide ($Zn(OH)_2$).

Salts are produced by the replacement of $H^+$ ions by base radicals or by the substitution of $OH^-$ ions by acid radicals. Cations and anions always combine to form an electrically neutral substance. The electrolytic solution according to the invention in particular contains hydroxo zincates. These are to be understood as meaning the coordination compounds of zinc, i.e., the zinc represents the central atom of this anion complex. These water-soluble complexes are formed when zinc salt solutions are mixed with excess alkali metal or alkaline-earth metal base. They then precipitate as amorphous precipitates which are slowly transformed into crystalline forms.

If zinc hydroxide ($Zn(OH)_2$) or zinc oxide (ZnO) is added to an excess potassium hydroxide solution (KOH), they dissolve to form hydroxo zincates. Zincates of this type may include, for example, $ZnO_2^{2-}$, $ZnO_4^{6-}$, $Zn(OH)_3^-$, $Zn(OH)_4^{2-}$ or $Zn(OH)_6^{4-}$. Moreover, zinc hydroxide ($Zn(OH)_2$) is amphoteric, it can function as a proton acceptor or as a proton donor. The subsequent crystallization of the hydroxo zincates is accelerated by the oxidizing agents according to the invention. The more quickly this crystallization takes place, the rougher and more porous the deposited adhesion promoter layer becomes, which results in much stronger adhesion.

The base, the oxidizing agent, the silicate and the zincate may each be present in a concentration of 1-5000 mmol/l. However, it is particularly advantageous if the concentrations of the base, the oxidizing agent, the silicate and the zincate are each present in ranges from 1-500 mmol/l, since in this case the electrolytic solution is able to carry out favorable deposition of the adhesion promoter layer according to the invention even at relatively low current densities. There is a large number of different electrolytic solutions according to the invention due to these relatively broad variation ranges. For the person skilled in the art, it is in this context particularly advantageous that there is no need to take into account specific dependent relationships between the individual components.

In addition to the potassium hydroxide solution (KOH), it is also possible for the bases used to be rubidium hydroxide (RbOH), tetrabutylammonium hydroxide ($(C_4H_9)_4NOH$)), tetramethylammonium hydroxide ($(CH_3)_4NOH$)) and/or tetramethylammonium hydroxide ($(C_2H_5)_4NOH$)), in the same concentrations. This gives numerous possible combinations.

Ammonium salts are formed when using tetrabutylammonium hydroxide ($(C_4H_9)_4NOH$)), tetramethylammonium hydroxide ($(CH_3)_4NOH$)) and/or tetramethylammonium hydroxide ($(C_2H_5)_4NOH$)). Rubidium salts are formed when using rubidium hydroxide (RbOH).

The vanadates ($VO_4^{3-}$) used may be potassium vanadate ($K_3VO_4$), sodium vanadate ($Na_3VO_4$) and/or rubidium vanadate ($Rb_3VO_4$). The molybdates ($MoO_4^{2-}$) used may be potassium molybdate ($K_2MoO_4$), sodium molybdate ($Na_2MoO_4$) and/or rubidium molybdate ($Rb_2MoO_4$) as oxidizing agents. The tungstate ($WO_4^{2-}$) used may be sodium tungstate ($Na_2WO_4*2H_2O$). The permanganates ($MnO_4^-$) used may be potassium permanganate ($KMnO_4$), sodium permanganate ($NaMnO_4$) and/or rubidium permanganate ($RbMnO_4$).

Therefore, in accordance with the invention, it is possible to use a wide range of different oxidizing agents. As a result, the composition of the electrolytic solution can be varied in virtually any desired way.

Reverse reactions of the zincates can be particularly reliably avoided by providing for the silicates used to be sodium water glass ($Na_2O:SiO_2$ (27% $SiO_2$)), potassium water glass ($K_2O:SiO_2$ (27% $SiO_2$)) and/or rubidium water glass ($Rb_2O:SiO_2$ (27% $SiO_2$)).

Preferred zincates are potassium zincate ($K_2Zn(OH)_4$) and/or sodium zincate ($Na_2Zn(OH)_4$) and/or rubidium zincate ($Rb_2Zn(OH)_4$). These salts are composed of the $K^+$ ions of the potassium hydroxide solution and the negatively charged zincate ions. The use of these zincates makes it possible to deposit adhesion promoter layers on a very wide range of chip systems used in the semiconductor industry.

In another embodiment of the present invention, an electroplating bath comprising the electrolytic solution described above is used for depositing the porous adhesion promoter layer.

In addition, the present invention relates to an electroplating process for depositing the porous adhesion promoter layer on at least one surface of an electrically conductive body.

In this process, first of all the electrically conductive body and the zinc electrode are dipped into the above-described electroplating bath that is to be provided.

If a substance which is more basic or alkaline than the substance of the anode is used for the electrically conductive body, there is no need to apply current for the deposition process. This is because the material of the electrically conductive body is made of the substance of the anode in the electrochemical series of the metals. Consequently, the tendency of the substance of the anode to change to the ions state is lower than that of the material of the electrically conductive body. The more chemically active substance is the material of the electrically conductive body. However, a precondition for chemical deposition without the application of current is for this deposition to take place quickly enough, since otherwise an undesirable homogeneous layer is deposited.

Electroless exchange reactions of this type occur in particular if aluminum and/or aluminum alloys are used as the material of the electrically conductive body, since in this case the aluminum displaces the zinc, which is to the right of it in the electrochemical series, out of the solutions of their salts in the electrolytic solution.

The deposition process may also be current-controlled. In this case, the zinc electrode and the electrically conductive body are both connected to a current source and in such a way that the zinc electrode is switched to the positive pole and the electrically conductive body to the negative pole.

The application of current starts the deposition of the porous adhesion promoter layer on the surface of the electrically conductive body. If the substance of the electrically conductive body is more base than the substance of the anode, the deposition operation is considerably accelerated by the application of current.

The rate of the deposition operation can be controlled by regulating the current density. The current intensity, like the use of the oxidizing agents, serves to control the porosity of the adhesion promoter layer. The deposition process takes place relatively slowly at a correspondingly lower current intensity, resulting in the deposition of a relatively homogeneous adhesion promoter layer. The operation of depositing the porous adhesion promoter layer is effected in a particularly advantageous way if a current density of approximately $i=60\ mA/cm^2$ is applied. The current density is in this case based on the surface area of the electrical body which has been dipped into the electrolytic solution.

A process of this type allows an adhesion promoter layer to be deposited quickly and uniformly on a metallic body. This adhesion promoter layer in particular has the morphology that has already been described above.

The process according to the invention can occur without the use of sodium, making it possible to avoid functional failures of semiconductors which have hitherto been caused in particular by the fact that sodium, on account of its small atomic radius, has often been dissolved out of the adhesion promoter layer and interfered with the electrical properties of the semiconductor. According to the invention, there is also no need to provide hexavalent chromium, which has hitherto made technical application complex and expensive.

It is preferable for the anode to include zinc, since particularly advantageous and porous morphologies of the adhesion promoter layer can be achieved using zinc.

In an advantageous embodiment of the invention, the electrically conductive body alternatively includes aluminum (Al), copper (Cu), silver (Ag), gold (Au) and/or an alloy and/or semiconductor materials, in particular silicon (Si), germanium (Ge) and gallium arsenide (GaAs). This gives rise to numerous possible uses of the process according to the invention.

Moreover, the invention also relates to a process for producing a plastic composite body. In this case, a porous adhesion promoter layer as described above is deposited on the electrically conductive body. Then, a polymer is provided and this polymer is joined to the electrically conductive body via the adhesion promoter layer.

The result of a process of this type is a plastic composite body which is very strongly held together and is not susceptible to the popcorn effect.

In this case, the polymer can be joined to the electrically conductive body by a molding, adhesive bonding, pressing and/or injection-molding process. The person skilled in the art can therefore select from a range of processes.

The invention also relates to the use of the processes described above for producing an electrically conductive body including an adhesion promoter layer and for producing a plastic composite body.

The invention is further described with reference to FIGS. 1 and 2.

FIG. 1 shows a side view of an electroplating bath 1. The electroplating bath 1 contains an electrolytic solution 4 which is composed of various components, namely a base, an oxidizing agent, a silicate and a zincate.

In a first exemplary embodiment, for the electrolytic solution 4, the base provided is potassium hydroxide solution (KOH), the oxidizing agent provided is potassium vanadate ($K_3VO_4^{3-}$), the silicate provided is sodium water glass ($Na_2O:SiO_2$ (27% $SiO_2$)), and the zincate provided is (ZnO). In this embodiment, the potassium hydroxide solution has a concentration of 170 mmol/l, the potassium vanadate has a concentration of 11.5 mmol/l, the sodium water glass has a concentration of 2.5 mmol/l and the zincate has a concentration of 13.8 mmol/l.

In a second exemplary embodiment, for the electrolytic solution 4, the base provided is potassium hydroxide solution (KOH), the oxidizing agent provided is potassium molybdate ($K_2MoO_4$), the silicate provided is sodium water glass ($Na_2O:SiO_2$ (27% $SiO_2$)) and the zincate provided is (ZnO). In this case, the concentrations are 170 mmol/l for the potassium hydroxide solution, 11.5 mmol/l for the potassium molybdate, 2.5 mmol/l for the sodium water glass and 13.8 mmol/l for the zincate.

If excess potassium hydroxide solution (KOH) is used, potassium salts, in particular zincates, are precipitated after the addition of zinc oxides.

An electrically conductive body 2 which is completely immersed in the electrolytic solution 4 of the electroplating bath 1 and is used as the cathode.

A zinc electrode 3 is arranged in the electrolytic solution 4 next to the electrically conductive body 2. An electrical line 8 with a power source 7 is connected to the electrically conductive body 2 and to the zinc electrode 3. The positive pole is directed toward the zinc electrode 3 and the negative pole toward the electrically conductive body 2. The two arrows in the electrical line 8 labeled "$e^-$" symbolize the flow of electrons from the zinc electrode 3 to the electrically conductive body 2.

A deposited adhesion promoter layer 9 is illustrated on the surfaces of the electrically conductive body 2. This adhesion promoter layer 9 accumulates on all the surfaces of the electrically conductive body 2 which are immersed in the electrolytic solution 4.

The zinc electrode 3 is dissolved during a deposition operation. This dissolution of that part of the zinc electrode 3 which is immersed in the electrolytic solution 4 is diagrammatically illustrated in FIG. 1.

The arrow 5 labeled "$Zn^{2+}+2e^- \rightarrow Zn$" characterizes a cathodic reduction of zinc ions at the electrically conductive body 2. Anodic oxidation 6 takes place in parallel with this at the zinc electrode 3, represented by the arrow 6 labeled "$\rightarrow Zn^{2+}$". The electrons $e^-$ released during this chemical reaction are withdrawn via the electrical line. The overall equation for the oxidation is: $Zn \rightarrow Zn^{2+}+2e^-$.

At the start of the deposition operation, current is applied between the zinc electrode 3 and the electrically conductive body 2. Thereafter, the zinc electrode 3 acts as the anode and the electrically conductive body 2 as the cathode. The anodic oxidation 6, in which elemental zinc Zn is oxidized to form zinc ions ($Zn^{2+}$) which are released from the zinc electrode 3, takes place at the zinc electrode 3. In the process, electrons ($e^-$) are released and migrate via the electrical line 8 to the electrically conductive body 2. The zinc electrode 3 is positively charged by the constant removal of the electrons.

Due to the migration of electrons from the zinc electrode 3 to the electrically conductive body 2, an excess of electrons is produced at the electrically conductive body 2. This negative charging of the electrically conductive body 2 attracts positively charged ions from the electrolytic solution 4. These in particular also include the zinc ions ($Zn^{2+}$) which have been oxidized in the zinc electrode 3. The circuit is therefore closed by the migration of the zinc ions from the electrically conductive body 2 to the zinc anode 3.

Cathodic reduction 5 of the zinc ions to elemental zinc ($Zn^{2+}+2e^- \rightarrow Zn$), which is deposited on the surface of the electrically conductive body 2, takes place at the surface of the electrically conductive body 2. This deposited layer represents the porous adhesion promoter layer 9 of the invention.

The exemplary embodiments use a voltage of U=100 V, a test temperature of T=60° C. and a current density of i=60 mA/cm$^2$. The voltage U, the test temperature T and the current density i can be selected in ranges of 0 V<U<150 V, 40° C.<T<80° C. and 1 mA/cm$^2$<i<500 mA/cm$^2$.

The cathodic reduction 5 of the zinc ions is accelerated by the oxidizing agents in the electrolytic solution 4, which already results in a porous morphology of the deposited adhesion promoter layer 9. In the process, the oxidizing agents themselves are reduced.

The use of potassium vanadate ($K_3VO_4^{3-}$) as oxidizing agent in the first exemplary embodiment and of potassium molybdate ($K_2MoO_4$) as oxidizing agent in the second exemplary embodiment accelerates the deposition rate of elemental zinc (Zn) in such a manner that the adhesion promoter layer 9 has the desired porous and crystalline morphologies.

The rate of the cathodic reduction 5 and therefore also the deposition rate of the adhesion promoter layer 9 are additionally determined by the flow of electrons. The rate of the deposition process and therefore the thickness and morphology of the adhesion promoter layer 9 can therefore be controlled by a user both by selecting the oxidizing agent and also by controlling the voltage and the current intensity.

The zinc anode 3 and the adhesion promoter layer 9 include the same material. In the exemplary embodiment, this is zinc Zn. The concentrations of the individual components of the electrolytic solution 4 remain approximately constant, since the number of zinc ions ($Zn^{2+}$) which are dissolved out of the zinc anode 3 as a result of the anodic oxidation 6 and enter the electrolytic solution 4 is substantially equal to the number of zinc ions ($Zn^{2+}$) which are cathodically reduced at and deposited on the electrically conductive body 2. There is therefore no need to check on an ongoing basis whether the concentrations of the individual components of the electrolyte 4 remain constant.

Figure 2:
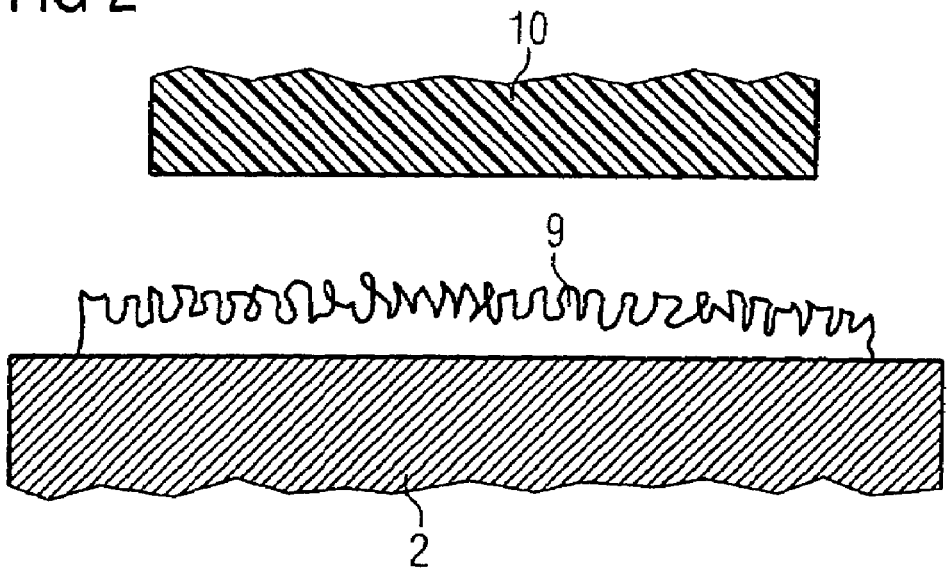
FIG. 2 depicts a cross section through a portion of an electrically conductive body including an adhesion promoter layer and through a polymer arranged above the adhesion promotion layer.

FIG. 2 shows a cross section through the electrically conductive body 2 including an adhesion promoter layer 9 and through a polymer 10 arranged above it.

To simplify the illustration, FIG. 2 illustrates the adhesion promoter layer 9 only on the top side of the electrically conductive body 2. The adhesion promoter layer 9 is the result of the electroplating deposition operation shown in FIG. 1.

FIG. 2 clearly reveals that the adhesion promoter layer 9 has sponge-like, needle-shaped and plateletlike morphologies. On account of this crystalline nature, it has a very large surface area which serves as engagement surface for adhesion to the polymer 10. With this morphology of the adhesion promoter layer 9 according to the invention, it is possible to achieve very strong adhesion of the polymer 10 on the electrically conductive body 2. When adhesion tests were carried out using adhesion promoter layers 9 of this type, excellent increases in adhesion which were in some cases improved by a factor of up to 20 compared to untreated surfaces were measured.

A polymer 10 is also shown above the electrically conductive body 2 including the adhesion promoter layer 9. The polymer 10 is joined to the adhesion promoter layer 9 in a subsequent process step, which is not illustrated here. These processes are, for example, injection-molding or other molding processes.

While the invention has been described in detail and with reference to specific embodiments thereof, it will be apparent to one skilled in the art that various changes and modifications can be made therein without departing from the spirit and scope thereof. Accordingly, it is intended that the present invention covers the modifications and variations of this invention provided they come within the scope of the appended claims and their equivalents.

What is claimed:

1. A process of preparing a structure by electrodeposition, the process comprising:

providing an electroplating bath comprising an electrolytic solution and an anode, wherein the electrolytic solution comprises at least one base, at least one oxidizing agent comprising at least one of vanadates ($VO_4^{3-}$), molybdates ($MoO_4^{2-}$),tungstates ($WO_4^{2-}$) and permanganates ($MnO_4^-$), at least one silicate, and at least one zincate;

introducing an electrically conductive body into the electroplating bath; and depositing a porous adhesion promoter layer on at least one surface of the electrically conductive body, the adhesion promoter layer including the same substance as the anode, and the adhesion promoter layer being deposited by cathodic reduction of metal ions of the anode and/or cathodic reduction of metal ions in electrolytic solution.

2. The process of claim 1, wherein a substance of the electrically conductive body is more basic than a substance of the anode.

3. The process of claim 1, wherein the deposition of the porous adhesion promoter layer by cathodic reduction is achieved by applying a flow of current to the anode and the electrically conductive body with a current density having a value of 60 $mA/cm^2$.

4. The process of claim 1, wherein the anode comprises zinc (Zn).

5. The process of claim 1, wherein the electrically conductive body comprises at least one of aluminum (Al), copper (Cu), silver (Ag), gold (Au), an alloy, silicon (Si), germanium (Ge) and gallium arsenide (GaAs).

6. The process of claim 1, further comprising:

forming a plastic composite body by securing a polymer to the porous adhesion promoter layer of the electrically conductive body by at least of molding, adhesive bonding, pressing and injection-molding.

7. The process of claim 1, wherein the electrically conductive body comprises a semiconductor material.

8. The process of claim 1, wherein the electrically conductive body comprises at least one of silicon (Si), germanium (Ge) and gallium arsenide (GaAs).

9. The process of claim 1, further comprising:

forming a semiconductor device including the electrically conductive body with adhesion promoter layer deposited on the at least one surface of the electrically conductive body.

* * * * *